United States Patent [19]

Williams et al.

[11] Patent Number: 4,581,876

[45] Date of Patent: Apr. 15, 1986

[54] BOX CLOSER

[75] Inventors: Roger S. Williams; Michael T. Beatty, both of West Point, Miss.

[73] Assignee: Bryan Foods, Inc., West Point, Miss.

[21] Appl. No.: 689,483

[22] Filed: Jan. 7, 1985

[51] Int. Cl.[4] ..... B65B 7/26

[52] U.S. Cl. ..... 53/484; 53/76; 53/137; 53/374; 53/377; 53/382; 53/415

[58] Field of Search ..... 53/76, 137, 207, 218, 53/374, 376, 377, 381 R, 382, 415, 484, 491; 493/180, 183

[56] References Cited

U.S. PATENT DOCUMENTS

| | | | |
|---|---|---|---|
| 2,280,904 | 4/1942 | Erekson | 53/456 |
| 2,654,981 | 10/1953 | Stenger | 53/374 |
| 2,909,880 | 10/1959 | Mumma | 53/377 |
| 2,993,319 | 7/1961 | Gaubert | 53/374 |
| 3,307,329 | 3/1967 | Lefief | 53/376 |
| 3,714,757 | 2/1973 | Feigel et al. | 53/75 |
| 3,953,956 | 5/1976 | Massman | 53/374 X |
| 4,006,575 | 2/1977 | Lee | 53/484 |
| 4,026,090 | 5/1977 | Loveland | 53/374 |
| 4,041,675 | 8/1977 | Loveland et al. | 53/374 X |

*Primary Examiner*—E. R. Kazenske
*Assistant Examiner*—Michael D. Folkerts
*Attorney, Agent, or Firm*—Charles Y. Lackey; William S. Burden

[57] ABSTRACT

A mechanism for automatically closing and sealing cardboard boxes, cartons and the like of various sizes. A four- or six-corner glued carton having a hinged cover is conveyed in a first direction to a location where the carton is maintained in a prescribed position. Carriage and closure assemblies are advanced simultaneously to initiate closing of the hinged cover and to subsequently completely close the cover and displace the closed carton in a second direction to a means for sealing the carton and to a conveyor means.

15 Claims, 18 Drawing Figures

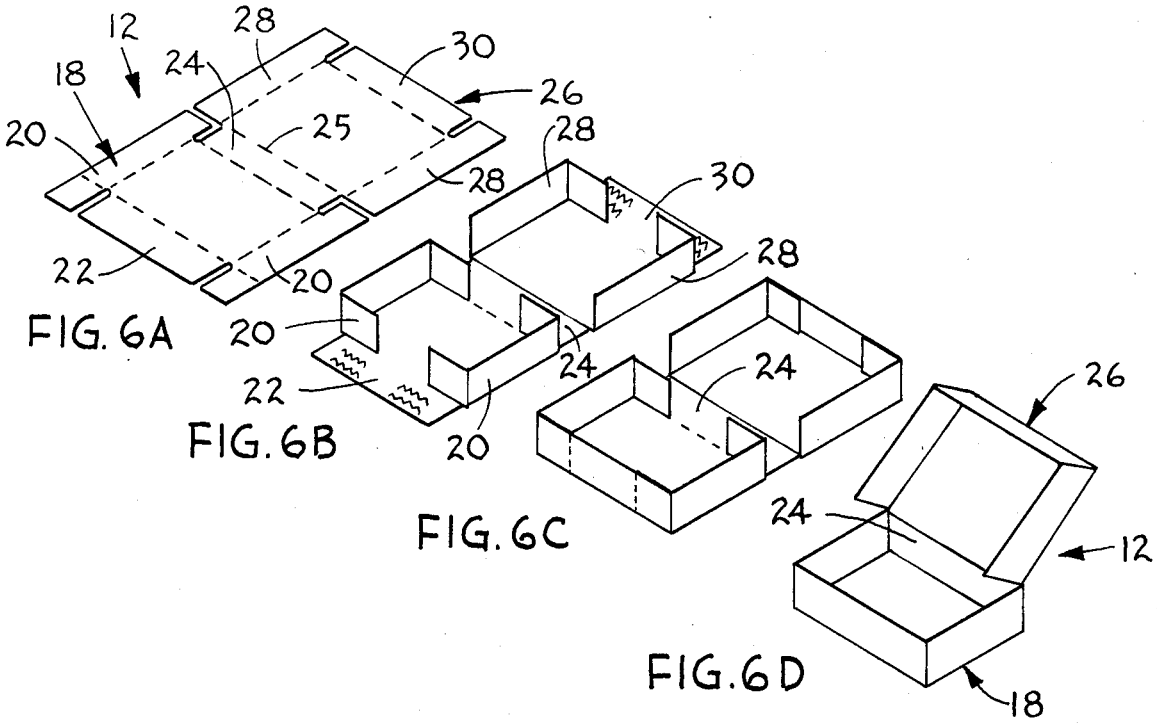
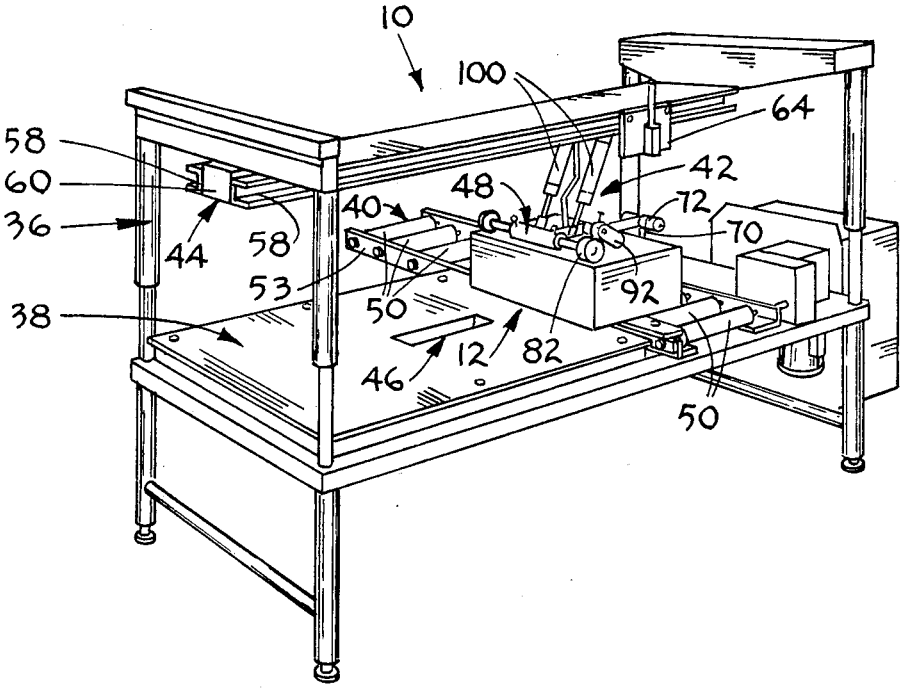
FIG. 1

BOX CLOSER

BRIEF SUMMARY AND OBJECTS OF THE INVENTION

This invention relates generally to a system for handling boxes or cartons, and more particularly to an apparatus for automatically closing and sealing a carton hinged cover. The invention is particularly applicable to the closing and sealing of cartons that have previously been filled with food products.

Briefly, a filled, open carton is directed by various guides and a conveyor to a prescribed location. With the carton base stationary, roll members initiate closing of the cover followed by spring biased presser members which continue to gradually close the cover by initially abutting the carton back wall and then sliding over the back wall and onto the cover. Pusher members engage the back wall to direct the carton over a tape applicator. Prior to reaching the tape applicator, the roll members are pivoted downwardly to completely close the carton. The pusher members continue to direct the sealed carton to a conveyor means.

One of the primary objects of the invention is the provision of a new and improved system for closing and sealing cartons.

Another object of the invention is the provision of a carton closing and sealing apparatus which is fully automatic in operation.

Still another object of the invention is the provision of a carriage assembly and a closure assembly for displacing and completely closing a carton having a hinged cover member.

Other objects and advantages of the invention will become apparent when considered in view of the following detailed description.

BRIEF DESCRIPTION OF THE DRAWINGS

FIG. 1 is a schematic, fragmentary, perspective view of one embodiment of the invention;

FIGS. 6A–6D are perspective views illustrating the various stages of the formation of a carton for receiving goods therein;

DETAILED DESCRIPTION OF THE INVENTION

Figure 2:
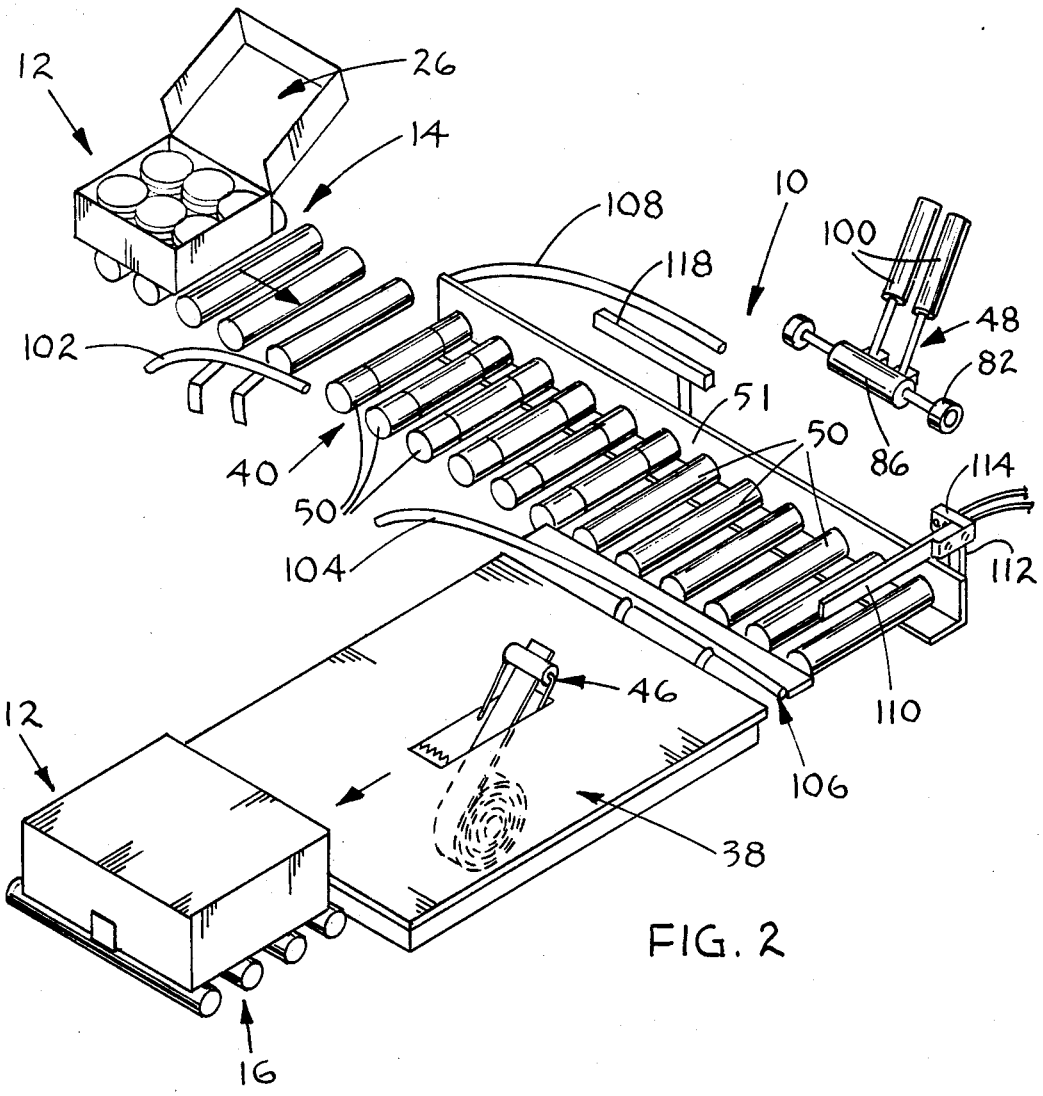
FIG. 2 is a diagrammatic, fragmentary representation of portions of the apparatus of the present invention and also illustrating conveyors for directing cartons to and from the apparatus.
Figure 10:
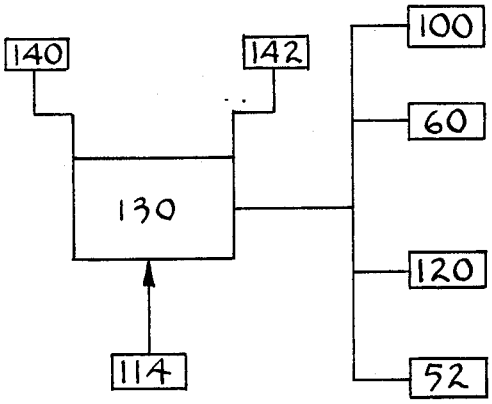
FIG. 10 is a block diagram of the various control components of the apparatus.

The box or carton closing and sealing apparatus 10 of the invention is adapted to receive cartons 12 filled with foodstuff or other materials from a conveyor 14, as shown by FIG. 2, close and seal the cartons, and transfer the cartons to a conveyor 16.

Each carton 12 consists of a base 18 including side 20, front 22 and rear 24 walls, and a cover 26 including a front wall 30 and side walls 28. The cartons may be assembled from flat blanks, as shown by FIGS. 6A–6D. Glue may be provided to secure front wall 22 to in-turned portions of side walls 20 and to secure front wall 30 to in-turned portions of side walls 28. The cover 26 side and front walls overlap the base 18 front and side walls when the carton is closed. Glue may be provided to secure the rear wall 24 in-turned positions of the side walls 20 if so desired. The cover 26 is hinged to the rear wall 24 along fold line 25.

The embodiment of the invention illustrated includes a suitable frame assembly 36, a table top or support surface 38, a carton conveyor assembly 40, a carriage assembly 42, a closure assembly 48 carried by the carriage assembly, an assembly 44 for supporting and selectively conveying the carriage assembly, and a tape applicator 46.

The frame assembly 36 is generally rectangular supporting the table top 38 and the conveyor assembly 40 at a selected distance above the floor level. The uppermost surfaces of the table top and the rollers 50 of conveyor 40 are substantially aligned such that a carton 12 can be readily displaced from the rollers 50 onto the table top 38.

The frame assembly 36 also supports the carriage and closure assemblies 42, 48 by means of the assembly 44.

Figure 4:
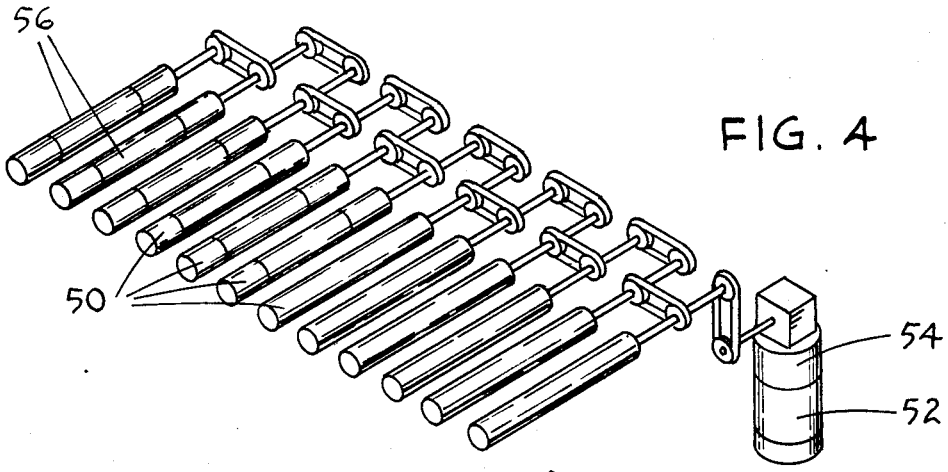
FIG. 4 is a schematic, perspective view of the drive assembly for the conveyor rollers of the apparatus.

The conveyor 40 includes a series of driven rolls 50, a portion of which extend from the frame 36 in cantilever fashion for alignment with the conveyor 14. The rollers 50 are supported for rotation by frame members 51 and 53 and may be driven by a motor 52 and clutch 54 through a series of belts and pulleys in the manner shown by FIG. 4. Approximately half of the rollers 50 are provided with a rubber coating 56 to facilitate movement of the cartons.

Figure 8:
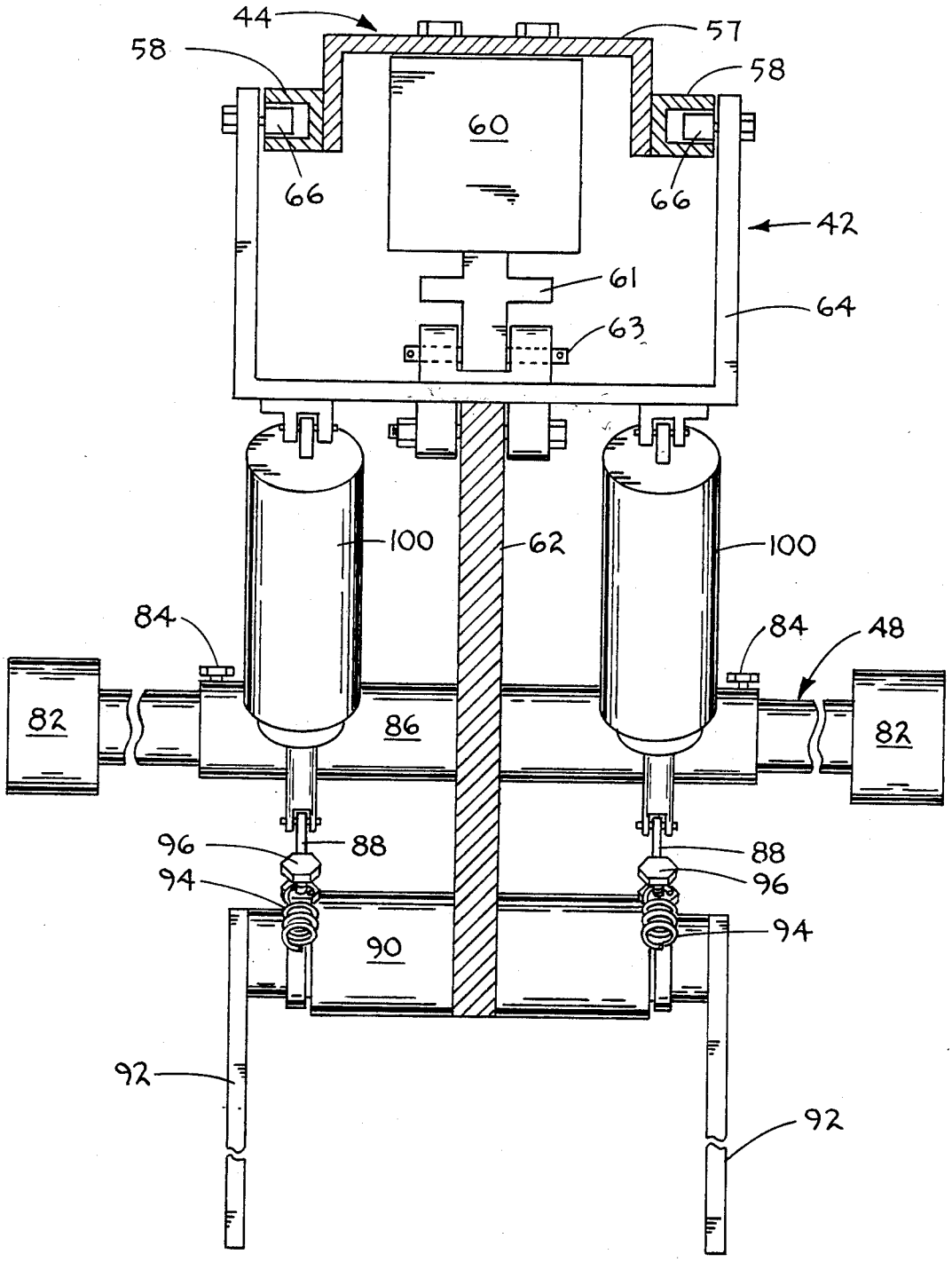
FIG. 8 is an enlarged, fragmentary, rear elevational view of the carriage assembly and the closure assembly.

Referring to FIGS. 1 and 8, the assembly 44 which supports the carriage assembly 42 for horizontal displacement is mounted adjacent the uppermost portions of the frame assembly 36, and includes a fixed support member 57 carrying a pair of spaced, opposed channel members 58 having a rodless pneumatic cylinder 60 positioned therebetween. The elongated cylinder 60 is secured to member 57 and preferably is of the type manufactured by Origa Corporation of Elmhurst, Ill. The Origa piston, not shown, is provided with a conventional coupling member 61 for attachment to the carriage assembly, as will be subsequently described.

Figure 5:
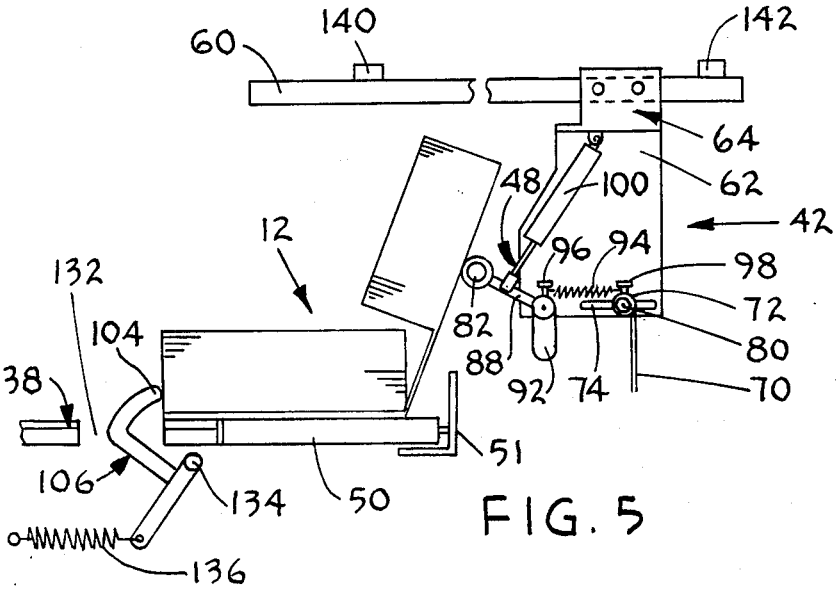
FIG. 5 is a schematic, side elevational view of the mechanism for closing a carton cover.

The carriage assembly 42 is supported for selective displacement longitudinally of the frame assembly 36 by the cylinder 60. Referring to FIGS. 1 and 5, the carriage 42 includes a vertically disposed plate 62 fixed to and depending from a trolley 64, shown by FIG. 8. The trolley 64 is generally U-shaped and includes rollers 66 which are supported by channel members 58. A pin 63 attaches the trolley 64 to the cylinder coupling member 61.

Figure 9:
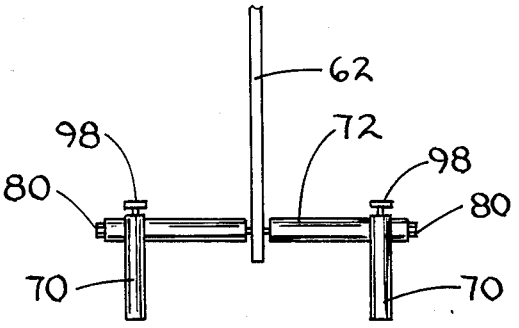
FIG. 9 is a fragmentary, rear elevational view of the carriage assembly, and illustrating the carton pusher members.

Carried by the vertical plate 62 is a pair of horizontally spaced pusher members 70, one such member being positioned on each side of the plate, as shown by FIG. 9. The pusher members 70 are secured to a mechanism 72 having a portion extending through a slot 74 in the plate 62. The elongated slot 74 is provided adjacent the lowermost portion of plate 62 and is disposed to permit horizontal adjustment of the pusher members 70 relative to the plate 62. Conventional fasteners 80 are provided to selectively secure the pusher members relative to the plate 62. Adjustment of the members 70 permits use with various cartons.

Referring now to FIGS. 5 and 8, the closure assembly 48 includes a pair of horizontally spaced roll members 82 horizontally adjustably supported by fasteners 84 relative to a support sleeve 86. A pair of parallel link members 88, one member being positioned on each side of plate 62, has end portions fastened to sleeve 86 and opposite end portions pivotably coupled to an elongated cylindrical member 90 which extends through and is fixed to the plate 62. Outwardly of the end of each cylindrical member 90 is a break-away presser member 92. Each member is spring biased to the vertical position, as shown by FIG. 5, by a spring 94 which has one end portion secured to a fastener 96 while the opposite end portion is coupled to fasteners 98 of the support mechanism 72. As the carriage 42 is displaced forwardly by the cylinder 60, the vertically disposed presser members 92 initially engage the back wall 24 of a carton, and upon continued displacement, the presser members 92 pivot to generally horizontal positions, as shown by FIG. 1 and FIGS. 7C—7E, thus overcoming the force of springs 94 which continue to apply pressure to the cover 26.

Also pivotably supported by the trolley 64 are a pair of fluid cylinders 100 positioned on opposite sides of the plate 62. Opposite ends of the cylinders 100 are pivotably connected to the link members 88. The cylinders 100 are provided to pivot the roll members 82 downwardly from the FIG. 7C position to the FIG. 7D position to engage the forward portion of the carton cover 26 to urge the cover to a completely closed position.

Various guides are provided for properly directing and positioning the carton prior to closing and sealing. Referring to FIGS. 1 and 2, as a filled carton 12 is moved along conveyor 14, a first guide 102 urges the carton rearwardly such that the back wall 24 is in engagement with or in close proximity to the vertical frame 51. A spring biased rail 104 of guide assembly 106 serves to direct the carton as it moves over rollers 50. Another guide 108, FIG. 2, serves to engage the carton cover 26 and lift the cover to the proper position or angle for subsequent engagement by the roll members 82 of the closure assembly 48.

Figure 3:
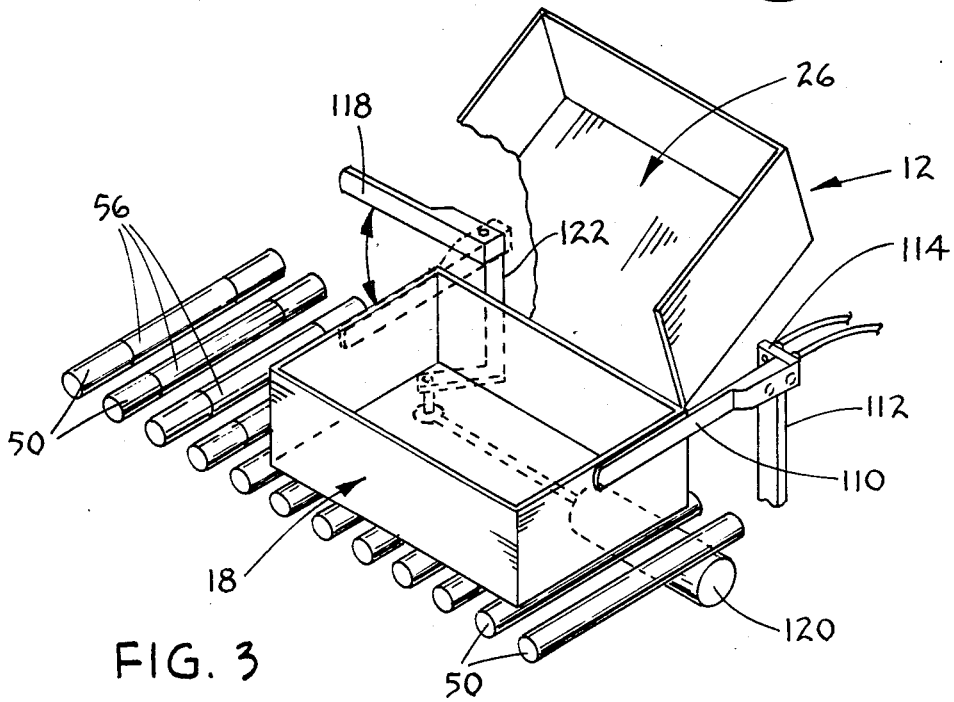
FIG. 3 is an enlarged diagrammatic view showing a portion of the carton positioning mechanism of the apparatus.

Adjacent the end of conveyor 40 is a stop member 110 for engaging a carton side wall 20 and limiting movement of the carton over rollers 50. The stop member 110 is supported by a bracket 112 which also supports a photoelectric sensor 114. Once the carton engages stop member 110, a knife or guide member 118 is pivoted from the full line position to the dotted line position of FIG. 3. The guide or knife 118 is displaceable by a fluid cylinder 120 through a linkage 122 between positions parallel to and transverse to the rollers 50.

Figure 7A:
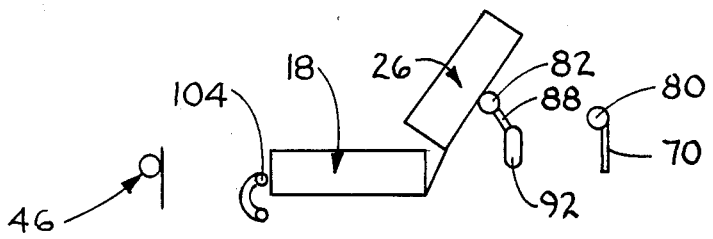
FIGS. 7A–7F illustrate diagrammatically various stages and movements of components in the closing and sealing of a carton hinged cover.
Figure 7B:
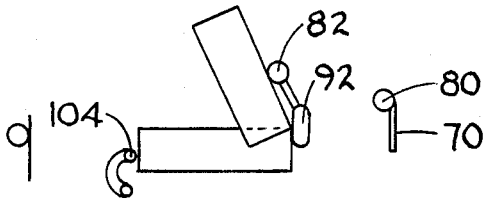
Figure 7C:
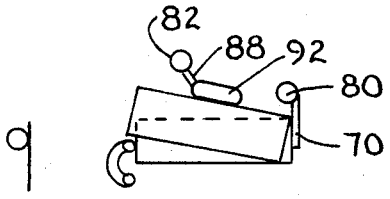
Figure 7D:
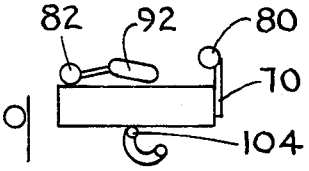

In the operation of the device, a filled carton 12 is advanced by conveyor 14 onto the rollers 50 of conveyor 40 which are driven by motor 52. The guides 104, 108 and frame 51 serve to guide the advancing carton. Substantially simultaneously with the carton side wall engaging the stop member 110, the sensor detects the presence of the carton and sends a signal to a programmable control means 130, including a timer, which initiates several functions in a conventional manner. The control means sends a signal to deactivate the motor drive and directs a signal to activate fluid cylinder 120 to pivot the knife 118 to the dotted line position, FIG. 3. The control means 130 also activates the cylinder 60 to initiate displacement of the carriage assembly 42 and the closure assembly 48 to the left, as shown by FIGS. 1 and 7A, until roll members 82 initially engage the cover 26. Continued displacement of the carriage and closure assemblies as shown by FIG. 7B results in pivoting of the cover 26 relative to the base 18. The base 18 is prevented from moving forward due to the rail 104. As the carriage and closure assemblies continue to be displaced, the vertically disposed spring biased presser members 92 engage the carton and begin pivoting towards a horizontal position, thus urging the wall 24 to a vertical position and to gradually urge the cover 26 downwardly. As the pusher members 70 engage the back wall 24, as shown by FIGS. 7C and 7C, the force applied to the carton 12 overcomes the spring resistance applied by spring 136 to the bar 104, and the bar moves about pivot 134 and into an opening 132 between the conveyor 40 and the support surface 38. At this time the fluid cylinders 100 are actuated through the timer of the control means 130 to urge the links 88 downwardly and force the cover 26 to a completely closed position, as shown by FIG. 7D. As the pusher member 70 continue to slide the carton from the conveyor 40 and onto surface 38, the carton, having the cover maintained completely closed by the roll member 82 and the presser member 92, is displaced over the tape applicator 46 to apply a length of tape T to the lower and front portions of the carton to seal closed the cover. The applicator 46 is a conventional taping head preferably of the type manufactured by Durable Packaging Corp., Chicago, Ill. The pusher members 70 continue forward to slide the sealed carton from surface 38 and onto conveyor 16, FIG. 2.

Figure 7E:
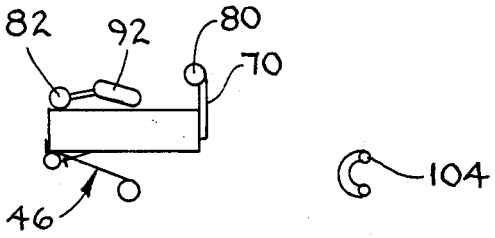
Figure 7F:
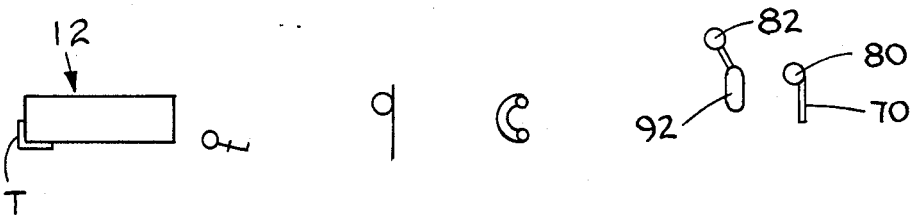

When the piston of cylinder 60 has been displaced a distance sufficient to remove the carton from surface 38, a switch 140 is contacted by trolley 64 and through control means 130 the direction of movement of the piston is reversed to move the carriage and closure assemblies to the right, as shown by FIGS. 5 and 7E, where movement of the cylinder piston is arrested upon trolley 64 engaging a second switch 142. The apparatus is now ready to receive another carton from the conveyor 14.

The switches 140, 142 may be adjustably positioned relative to the length of the Origa cylinder 60 depending upon the size of the cartons.

What is claimed is:

1. An apparatus for closing and sealing a carton having a base portion including front, rear and side walls and a cover portion hinged to the base portion rear wall and including a front wall and side walls for overlapping said base portion front and side walls when said cover portion is in the closed position comprising means for directing an open carton along a generally horizontal first prescribed path to a selected position, displaceable closure means for initiating simultaneous pivotable displacement of said cover portion front and side walls relative to said base portion rear wall and for subsequently completely closing said cover portion upon continued displacement of said closure means, carriage means for supporting said closure means, means for supporting said carriage means and for selectively displacing said carriage means and said closure means along a generally horizontal, second prescribed path, means coupled to said carriage means for displacing said carton from said selected position and along said generally horizontal second prescribed path, and means for securing said cover portion to said base portion.

2. Apparatus as recited in claim 1, wherein said first and said second prescribed paths are at right angles to each other.

3. Apparatus as recited in claim 1, said means for directing a carton to said selected position including a conveyor.

4. Apparatus as recited in claim 3, said means for directing an open carton to said selected position further including guide means and means for arresting displacement of said open carton.

5. Apparatus as recited in claim 4, said guide means including a spring biased rail positioned at the front wall of the carton base portion.

6. Apparatus as recited in claim 5, said means for displacing said carton along said second prescribed path urging said carton against said spring biased rail to displace said spring biased rail to a location below the carton.

7. Apparatus as recited in claim 1, said means for supporting and selectively displacing said carriage means including elongated, rodless, fluid cylinder means positioned above the carton and generally aligned with said second prescribed path.

8. Apparatus as recited in claim 1, said carriage means including a trolley and vertically disposed member suspended from said trolley.

9. Apparatus as recited in claim 8, said means for selectively displacing and supporting said carriage means including spaced channel members for supporting said trolley, and elongated fluid cylinder means for displacing said trolley relative to said channel members.

10. Apparatus as recited in claim 1, wherein said closure means includes presser members for abutting said carton base portion rear wall and for displacement along said cover portion to urge the cover portion towards a closed position.

11. Apparatus as recited in claim 1, said closure means including means selectively displaceable relative to said carriage means for forcing said cover portion to a completely closed position.

12. Apparatus as recited in claim 1, wherein said closure means includes displaceable means for applying pressure to said cover portion.

13. Apparatus as recited in claim 12, said displacement means for applying pressure to said cover portion including pivotably mounted, fluid-actuated means for pivoting said cover portion relative to said base portion, and pivotably mounted, spring biased presser members for initially engaging said base portion rear wall and for subsequently pivoting to apply pressure to said closure portion.

14. Apparatus as recited in claim 1, wherein said closed carton is displaced over said securing means to apply a length of tape to the front and lower portions of the closed carton.

15. The method of closing and sealing a carton having a base and a closure wherein the base includes front, rear and side walls and the closure includes front and side walls and is hinged to the base rear wall for overlapping the base portion front and side walls in the closed position comprising the steps of:

advancing the open carton along a generally horizontal first prescribed path to a preselected location, displacing the closure relative to the base to initiate closing of the carton while retaining the base front wall in a fixed position at said preselected location, applying pressure to the base rear wall to urge the rear wall to a vertical position while retaining the carton base front wall in said preselected location, applying a biasing pressure to the cover gradually from the base rear wall towards the cover front wall to urge the cover towards a closed position, while retaining the base front wall in said preselected location, displacing the carton in a generally horizontal, second prescribed path, applying pressure to the forwardmost portion of the cover to close completely the carton as the carton is advanced along the second prescribed path, and sealing the closure front wall to the base.

* * * * *